US005606301A

United States Patent [19]

Ishimura

[11] Patent Number: 5,606,301

[45] Date of Patent: Feb. 25, 1997

[54] MICRO-CHIP FUSE AND METHOD OF MANUFACTURING THE SAME

[75] Inventor: Koh Ishimura, Kanagawa-ken, Japan

[73] Assignee: SOC Corporation, Tokyo, Japan

[21] Appl. No.: 314,287

[22] Filed: Sep. 30, 1994

[30] Foreign Application Priority Data

Oct. 1, 1993 [JP] Japan ..... 5-277257

[51] Int. Cl.[6] ..... H01H 85/04; H01H 85/38; H01H 69/02

[52] U.S. Cl. ..... 337/290; 337/297; 337/282; 29/623

[58] Field of Search ..... 337/297, 296, 337/282, 152; 29/623; 437/922

[56] References Cited

U.S. PATENT DOCUMENTS

| | | | |
|---|---|---|---|
| 1,053,606 | 2/1913 | Johnston . | |
| 1,912,431 | 6/1933 | Cook et al. . | |
| 3,261,951 | 7/1966 | Jacobs . | |
| 4,135,175 | 1/1979 | Perreault . | |
| 4,215,331 | 3/1985 | Kozacka . | |
| 4,503,415 | 3/1985 | Rooney | 337/160 |
| 4,599,596 | 7/1986 | Arikawa | 337/201 |
| 4,608,548 | 8/1986 | Borzoni | 337/201 |
| 4,748,491 | 5/1988 | Takagi . | |

FOREIGN PATENT DOCUMENTS

| | | |
|---|---|---|
| 0275980 | 7/1988 | European Pat. Off. . |
| 3634167 | 4/1987 | Germany . |
| 9206792 U | 8/1992 | Germany . |
| 9206498 U | 8/1992 | Germany . |
| 5-166454 | 7/1993 | Japan . |
| WO85/01149 | 3/1985 | WIPO . |

*Primary Examiner*—Leo P. Picard
*Assistant Examiner*—Stephen T. Ryan
*Attorney, Agent, or Firm*—Wenderoth, Lind & Ponack

[57] ABSTRACT

A micro-chip fuse and a method of manufacturing the fuse is disclosed which includes a fusible element made of a metallic film that is formed by a depositioning process. Through-bores are provided through a first substrate and filled with a photosensitive resist to make smooth the surface of the first substrate. After curing the resist, metal is deposited on the surface of the first substrate to form a metallic film. A photosensitive resist is applied to the metallic film and a photomask is placed on the resist to effect an exposure and a development. The metallic film is etched and the resists are removed to form the fusible elements made of the metallic film extending over the through-bores. A second substrate is placed under the first substrate, and a third substrate including recesses for cover the through-bores is placed on the first substrate to laminate them. Electrodes are provided on the ends of the substrates. The laminated substrates are divided into individual micro-chip fuses.

8 Claims, 7 Drawing Sheets

MICRO-CHIP FUSE AND METHOD OF MANUFACTURING THE SAME

BACKGROUND OF THE INVENTION

1. Field of the Invention

The present invention relates to a micro-chip fuse and a method of manufacturing the same, the micro-chip fuse being utilized for surface mounting on a printed board by using a metallic film as a fusible element.

2. Description of the Prior Art

In recent years, a control unit for an electric appliance in which a fuse is incorporated has been miniaturized to a great extent, and in line with this tendency of miniaturization, the fuse has been miniaturized as well. In the case of a fusible element made of a metallic wire, there is a limitation in the technique in itself of producing a fusible fine wire. Therefore, as to a micro-chip fuse to be applied to a surface mount on a printed board, a fusible element comprised of a metallic film adhered to the surface of the main body made of ceramic material has been proposed. An example of such a fusible element is disclosed in the official gazette of Japanese Patent Laid-open No. 5-166454.

Fusion of a fuse will result from the balance between the heating value generated at the fusible element and the heating value radiated from the fusible element. For this reason, the best construction to keep the pre-arcing time current characteristic of a fuse to be uniform is such a construction in which the fusible element does not contact portions of a fuse other than the electrodes.

A micro-chip fuse is apt to be influenced by external heat due to being extremely small in size. Furthermore, since the fuse as disclosed in the prior art is so constructed that a fusible element is in contact with the main body and other portions, the heat generated at the fusible element may escape from the portions in contact with the fusible element. Also, depending on the structure of a printed board on which a chip fuse is to be surface-mounted, the heat generated at the printed board may be conducted to the fuse, resulting in a change of the characteristics of the fuse. In such a case, the inherent characteristics of the fuse cannot be maintained, resulting in the possibility of damage to the printed board in the worst case.

SUMMARY OF THE INVENTION

An object of the present invention is to provide a micro-chip fuse for a surface mount on a printed board and a method of manufacturing the same, the fuse being capable of always maintaining the inherent pre-arcing time current characteristic and positively melting when an abnormal current flows therethrough.

To achieve this object, a micro-chip fuse according to the present invention comprises a main body constructed by laminated layers of at least two substrates made of heat-resistant, electrically insulating material. The main body has a space therein. A fusible element made of a metallic film is formed by a deposition process and has both end portions and a middle portion. Both end portions are sandwiched between the substrates, and the middle portion extends within the space. Electrodes provided at the opposite ends of said main body are electrically connected to the both end portions of the fusible element.

According to the construction as described above, since a fusible element made of a metallic film is extended within the space defined within the main body of a chip-fuse made of lamination of at least two substrates, the heat generated at the fusible element does not escape to any other portions of the fuse, thus making it possible to always maintain the inherent characteristics of the fuse.

Furthermore, since the fusible element is not in contact with the main body or the like of the fuse, it is hardly influenced by the heat generated at the printed board, on which surface the fuse is mounted, whereby the inherent characteristics of the fuse can always be maintained.

To achieve the object mentioned above, a method of manufacturing a micro-chip fuse according to the present invention comprises the steps of providing at least one through-bore through a first substrate made of a heat-resistant, electrically insulating material, filling the through-bore with a first photosensitive resist to make smooth at least one surface of the first substrate, the surface including the portion of said through bore, curing the portion of the filled first photosensitive resist at the side of the smoothed surface, depositing metal on the smoothed surface of the first substrate to form a metallic film, applying a second photosensitive resist on the metallic film, placing on said second photosensitive resist a photomask including a pattern of a desired shape of a fusible element, effecting exposure and development, etching said metallic film, and removing said photosensitive resists to form the fusible element made of the metallic film extending over said through-bore, placing said first substrate on a second substrate made of a heat-resistant, electrically insulating material in such a manner that the surface of said first substrate opposite to the surface on which said fusible element is formed faces said second substrate, placing a third substrate made of heat-resistant, electrically insulating material and including at least one recess on said first substrate in a manner such that said recess is in alignment with said through-bore, laminating said first, second and third substrates, and providing electrodes on said substrate, said electrodes being electrically connected to both ends of said fusible element.

To achieve the object mentioned above, another method of manufacturing a micro-chip fuse according to the present invention comprises the steps of providing at least one recess on a first substrate made of a heat-resistant, electrically insulating material, filling said recess with a first photosensitive resist to make smooth the surface of said first substrate, said surface including portion of said recess, curing said filled first photosensitive resist; depositing metal on said smoothed surface of said first substrate to form a metallic film, applying a second photosensitive resist on said metallic film, placing on said second photosensitive resist a photomask including a pattern of the desired shape of a fusible element, effecting an exposure and a development, etching said metallic film, removing said photosensitive resists to form the fusible element made of the metallic film extending over said recess, placing a second substrate made of a heat-resistant, electrically insulating material and including at least one recess, on said first substrate in a manner that said recess of said second substrate is in alignment with said recess of said first substrate, laminating said first and second substrates, and providing electrodes on said substrate, said electrodes being electrically connected to both ends of said fusible element.

Accordingly, a fusible element made of a metallic film can be extended within the space provided within the main body of a fuse without getting in contact with other portions of a fuse, and a micro-chip fuse having a similar construction to that of a tube type fuse can be manufactured.

DESCRIPTION OF THE PREFERRED EMBODIMENTS

Some embodiments of the present invention will now be explained by referring to the accompanying drawings.

First, a method of manufacturing a fuse by laminating three substrates will be explained.

FIGS. 1A through 1K illustrate steps of manufacturing a micro-chip fuse according to an embodiment of the present invention.

Figure 1A:
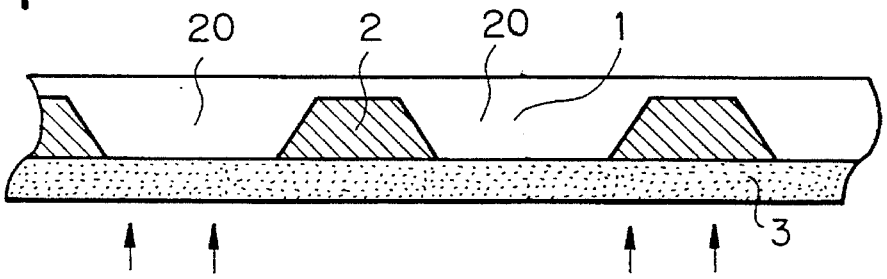
FIGS. 1A through 1K illustrate steps of manufacturing a micro-chip fuse according to an embodiment of the present invention.

As shown in FIG. 1A, a substrate 2 which is located intermediate to three substrates to be laminated is provided with a plurality of through-bores 20. The through-bores 20 provide spaces around the fusible element when a fuse has been constructed. In order to extend the fusible element over the through-bores 20, they are temporarily filled with a photosensitive resist 1. The substrate 2 is placed on a glass sheet 3 and the photosensitive resist 1 is applied on the substrate 2 in an amount sufficient to fill in the through-bores 20. Subsequently, pre-baking is conducted so that the resist surface in contact with the glass sheet 3 can be made smooth.

Figure 1B:
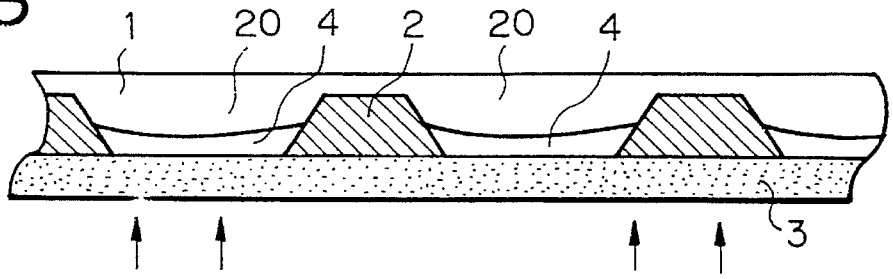

Subsequently, as shown in FIG. 1B, exposure is done from below, such that the photosensitive resist 1 which is filled in the through-bores 20 provided at the substrate 2 is cured. In the meantime, the above pre-baking may be omitted, and this exposure process may also make smooth the resist surface in contact with the glass sheet 3.

Figure 1C:
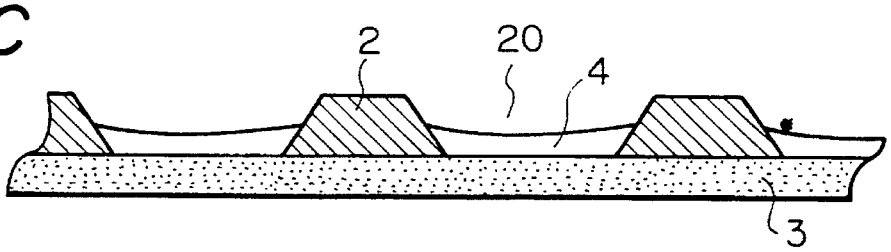

Then as shown in FIG. 1C, when the portion of the photosensitive resist 1 which has not been cured is removed, the cured resist 4 is left at the through-bores 4 provided at the substrate 20 to fill the same.

Figure 1D:
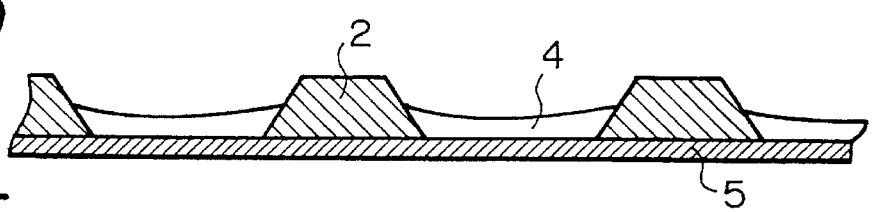

Subsequently as shown in FIG. 1D, the glass sheet 3 is taken away and a metallic film 5 is vapor-deposited. Since the through-bore portions 20 provided at the substrate 2 are filled with the cured resist 4 and made smooth thereby, the metallic film 5 is formed as a thin film of uniform thickness.

Figure 1E:
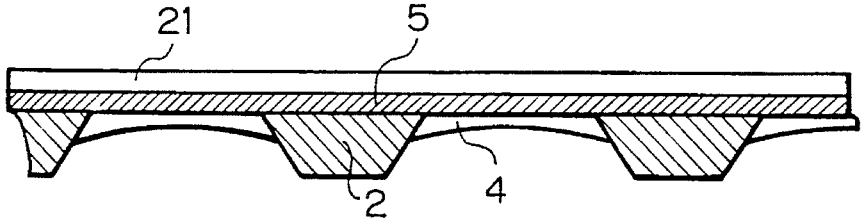

As shown in FIG. 1E, the vapor-deposited metallic film 5 is turned upside down and a photosensitive resist 21 is applied thereon.

Figure 1F:
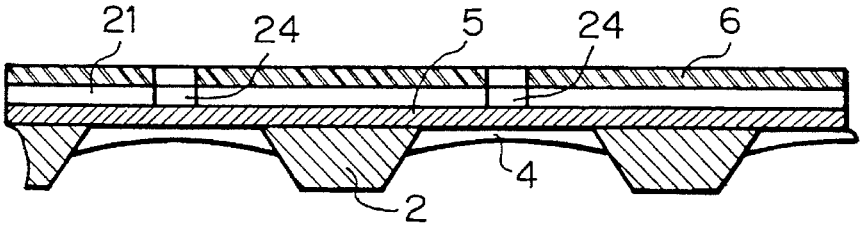

Subsequently as illustrated in FIG. 1F, a photomask 6 having a pattern corresponding to the shape of a fusible element is placed on the photosensitive resist 21, and then exposure is executed. In this way, the photosensitive resist 21 is cured to a shape similar to that of the fusible element to provide a cured resist 24.

Figure 1G:
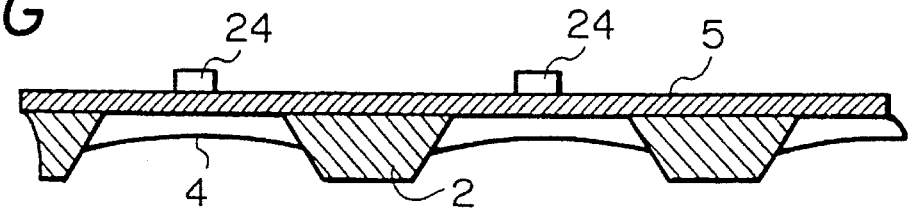

Subsequently as shown in FIG. 1G, the photomask 6 is taken away and the portion of the photosensitive resist 21 which was not cured is washed with solvent and removed (a developing process), whereby a cured resist 24 having a shape similar to that of a fusible element is formed on the metallic film 5.

Figure 1H:
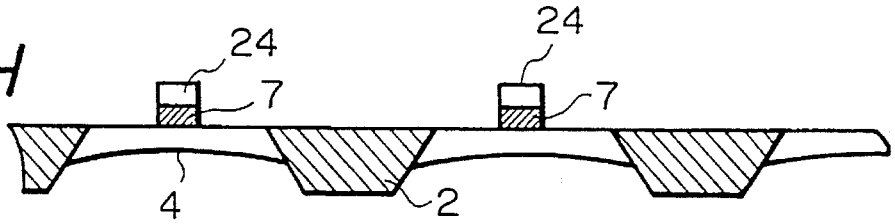

After this, as illustrated in FIG. 1H, when the metallic film 5 is etched, the metallic film 5 is removed to leave the portion thereof which will become a fusible element 7.

Figure 1I:
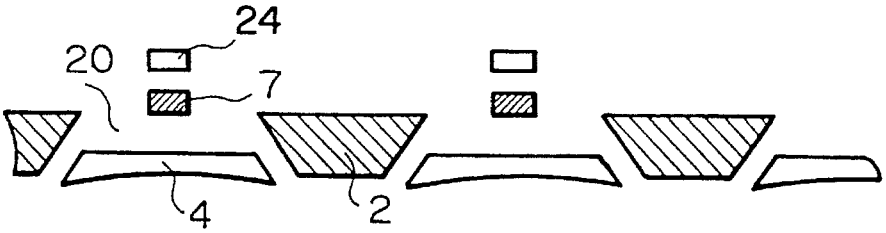

Subsequently, as shown in FIG. 1I, the cured resists 24 and 4 which are respectively provided on and under the fusible element 7 are removed, whereby a fusible element 7 which is extended over the through-bore 20 on the substrate 2 is provided. The through-bore 20 is shaped into a truncated cone form with the diameter thereof at the side of the fusible element 7 being smaller than that thereof at the opposite side, whereby the cured photosensitive resist 4 can be easily removed. However, the present invention is not intended to be limited to this shape.

Figure 1J:
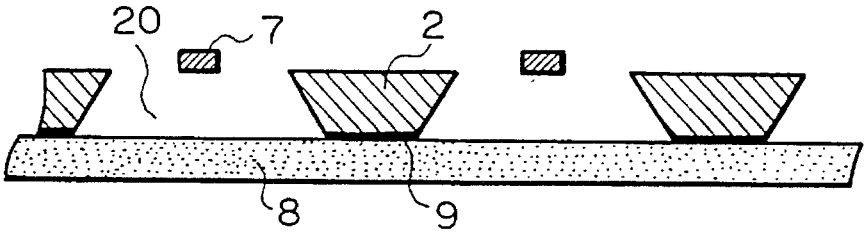

Subsequently as illustrated in FIG. 1J, a substrate 8 which serves to cover the through-bores 20 provided on the substrate 2 is bonded to the substrate 2 by means of a bonding agent 9.

Figure 1K:
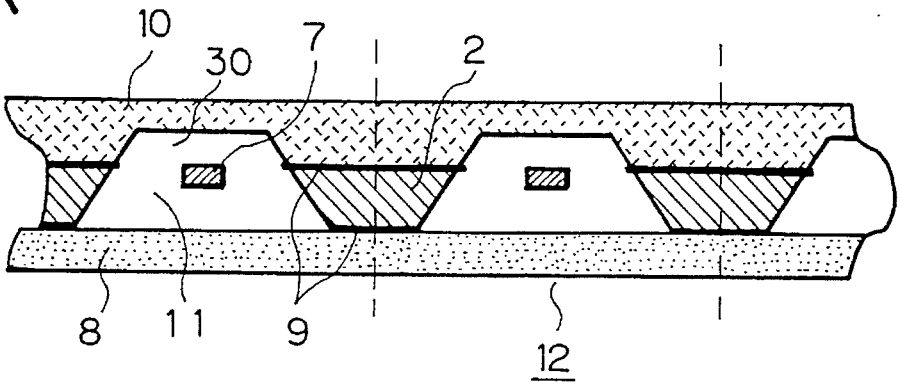

Then, as shown in FIG. 1K, a substrate 10 having recesses 30 corresponding to the through-bores 20 provided on the substrate 2 is bonded to the substrate 2 by means of a bonding agent 9 in a manner such that each recess 30 and each corresponding through-bore 20 are in alignment with each other to form a space 11 around the fusible element 7.

In this manner, spaces 11 are respectively provided around the fusible elements 7, and a construction is provided such that the fused portion of a fusible element does not get in touch with the main body of a fuse constituted by lamination of respective substrates 10, 2 and 8. In FIG. 1K, reference numeral 12 designates a fuse unit having a main body of three layer construction. After the unit is divided and each provided with electrodes, it then functions as a fuse.

Figure 2A:
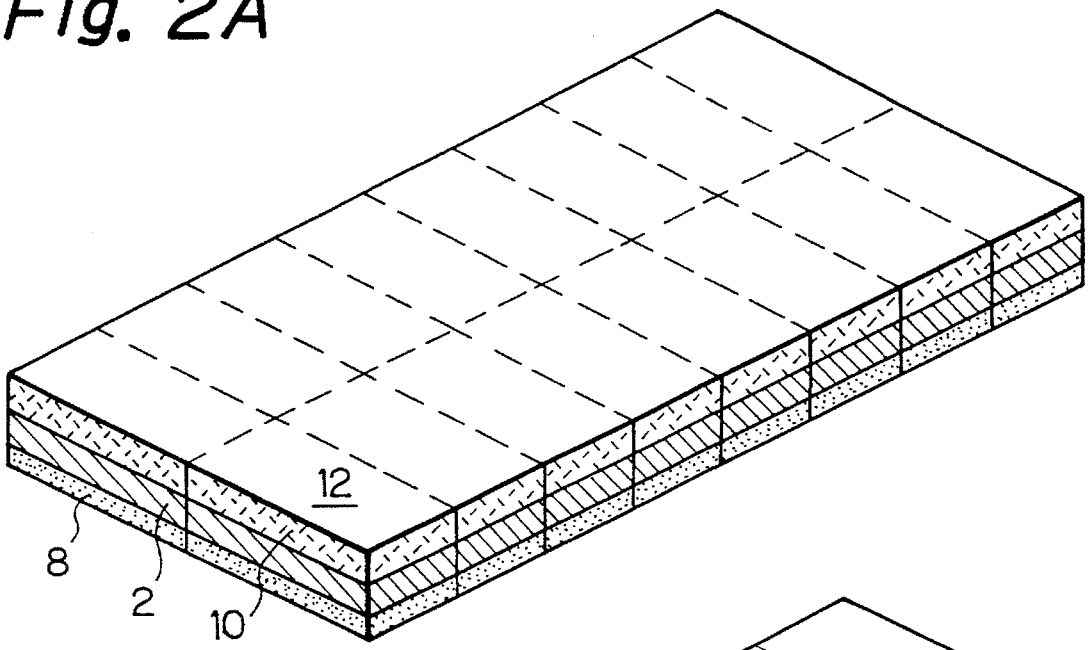
FIG. 2A illustrates an example of substrates laminated according to the steps shown in FIGS. 1A through 1K.

FIG. 2A illustrates an example of the substrates laminated according to the steps shown in FIGS. 1A through 1K. While electrodes may be attached to the respective fuse units 12 after the laminated substrates 10, 2 and 8 are together divided into a plurality of fuse units 12, according to the present embodiment, electrodes are attached at one time to a plurality of fuse units 12.

Figure 2B:
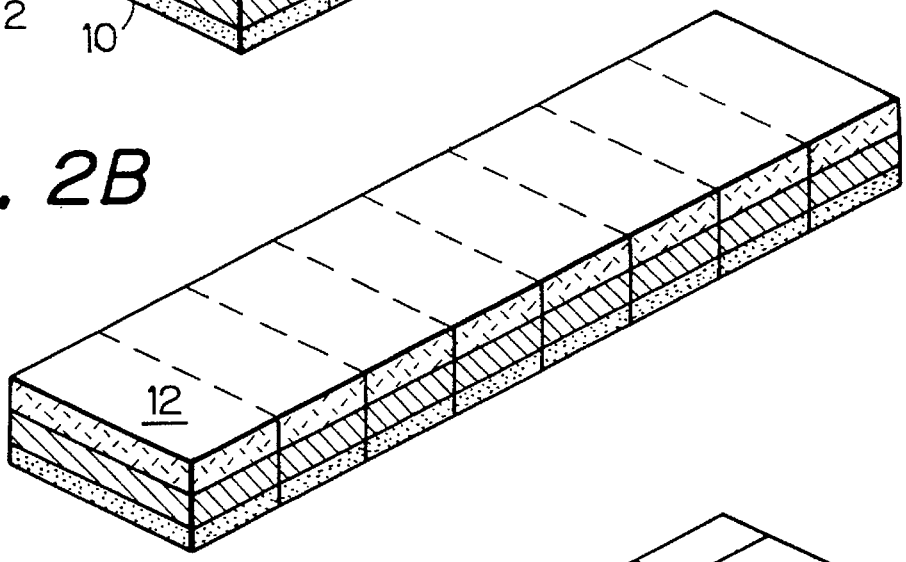
FIG. 2B illustrates an example of laminated substrates which have been cut in a manner where the fusible elements within fuse units are arranged in parallel.

FIG. 2B illustrates an example of the laminated substrates which have been cut so that the fusible elements within the fuse units are arranged in parallel. Since electrodes are collectively attached to a plurality of fuse units 12, the substrates are cut so that fusible elements are arranged in parallel in the fuse unit 12 as shown in FIG. 2B.

Figure 3:
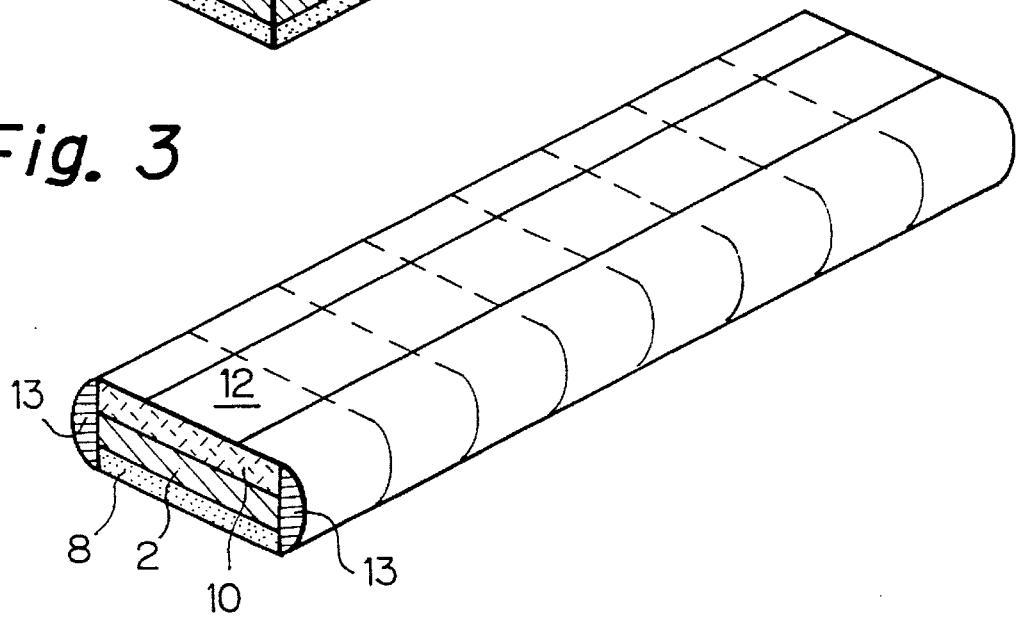
FIG. 3 illustrates an example of plurality of fuse units shown in FIG. 2B to which electrodes have been attached at one time.
Figure 4:
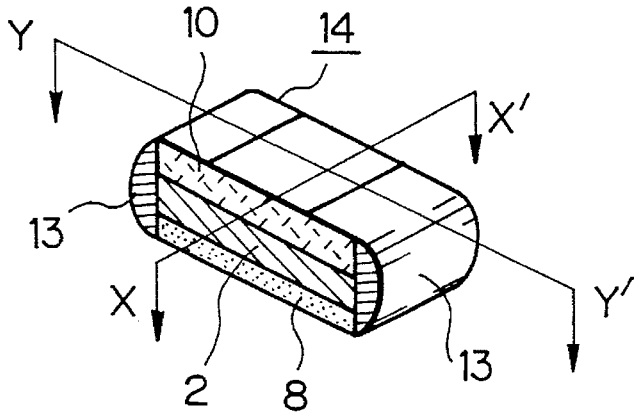
FIG. 4 is an external view of a micro-chip fuse of the present invention.

FIG. 3 illustrates an example of the plurality of fuse units shown in FIG. 2B, to which electrodes are attached at one time. As shown in FIG. 3, electrodes 13 and 13 are collectively attached to the plurality of fuse units 12. Subsequently, the plurality of fuse units 12 with electrodes 13 are individually cut to provide a micro-chip fuse as shown in FIG. 4.

Figure 5:
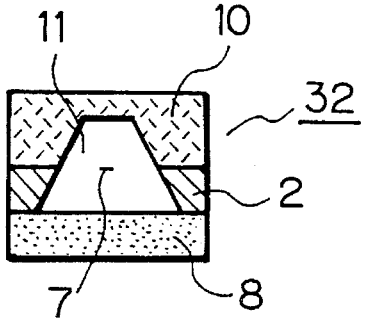
FIG. 5 is a sectional view taken along the line X—X' in FIG. 4.
Figure 6:
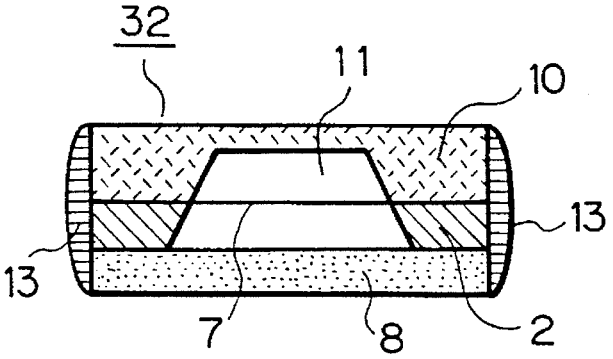
FIG. 6 is a sectional view taken along the line Y—Y' in FIG. 4.

Next, the construction of a micro-chip fuse 14 which has been manufactured in accordance with the steps above explained will be explained. FIG. 5 illustrates the section taken along the line X—X' in FIG. 4. FIG. 6 illustrates the section taken along the line Y—Y' in FIG. 4.

The micro-chip fuse 14 is a fuse having a length of approximately 1.5 mm–3 mm, a width of approximately 1.5 mm and a height of approximately 1.5 mm. The substrates 2, 8 and 10 which constitute the main body 32 of a fuse are respectively comprised of a heat-resistant, electrically insulating material having a thickness less than 1 mm. Since the space 11 is provided around the fusible element 7, the heat which may be generated at the printed board on which surface a micro-chip fuse 14 is mounted is not conducted to the fusible element 7, and also the heat generated at the fusible element 7 does not escape externally along the fuse body 32 of the fuse.

The shape of a trapezoid for the space defined around the fusible element 7 has been considered so that the cured resist can be easily removed. The shape of the space is not limited to this shape, however. It is to be understood, however, that if the space is shaped to be truncated-conical, the cured resist which might have been filled in the through-bore at the time of manufacture can be more easily removed.

In this way, according to the embodiment of the present invention, the fusible element can be accommodated within the main body comprised of heat resistant, electrically insulating material without the fuse portions of fuse element between the electrodes getting in touch with other portions of the fuse. The process described hereinbefore has made it possible to manufacture a fusible element more fine than the metallic wire which was conventionally used, besides making it possible to manufacture a fuse having a fusible element with a lower heat capacity. This allows any fusible materials among such metals, alloys or the like which could not be made finer due to the inherent characteristics of the materials in question to be utilized, making it possible to manufacture fuses having a pre-arcing time current characteristic which could not before be provided. In addition, since the thickness of the fusible element can be readily altered, fuses a different current capacity or other characteristics can be easily fabricated.

According to the embodiment of the present invention, a construction is provided so that the fusion portion of a fusible element between electrodes is prevented from getting in touch with other portions of the fuse, and the fusible element is constructed similarly to tube type fuse known as a normal fuse. Accordingly, the fuse according the present invention is extremely subminiature, and also has a high reliability.

Figure 7:
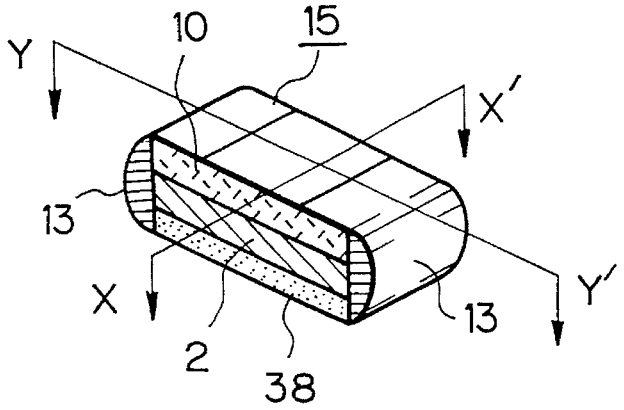
FIG. 7 is an external view of a micro-chip fuse according to another embodiment of the present invention.
Figure 8:
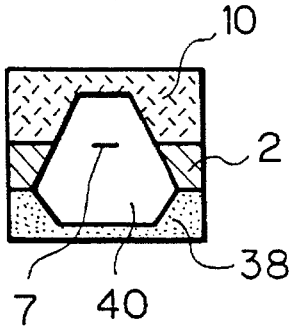
FIG. 8 is a sectional view taken along the line X—X' in FIG. 7.
Figure 9:
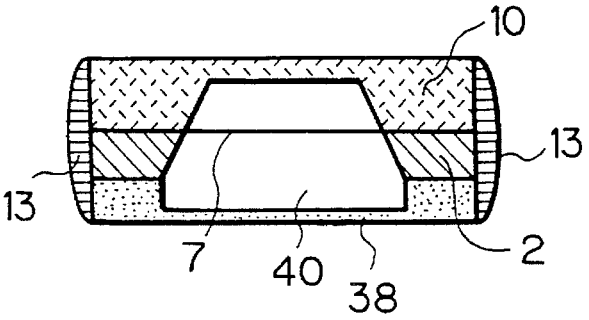
FIG. 9 is a sectional view taken along the line Y—Y' in FIG. 7, FIGS. 10A through 10H illustrate steps of manufacturing another micro-chip fuse according to another embodiment of the present invention.

FIGS. 7, 8, and 9 illustrate the construction of a micro-chip fuse 15 having a recess at the lower substrate disclosed in the previous embodiment and a larger space.

FIG. 7 shows the external view of the micro-chip fuse, which is not different from the one shown in the previous embodiment.

FIG. 8 is the sectional view taken along the line X—X' in FIG. 7, while FIG. 9 illustrates the sectional view taken along the line Y—Y' in FIG. 7. A recess 40 is provided at the lower substrate 38, and it is seen that a larger space than the previous embodiment is provided with the fuse. The micro-chip fuse can be manufactured in accordance with the same steps as employed in the previous embodiment.

According to the present embodiment, a larger space around a fusible element can be provided, so that even in a case where a metallic material having a high thermal expansion coefficient is employed for a fusible element, and the fusible element is elongated due to heat, the fusible element does not come into contact with the main body or the like of a fuse, whereby the inherent characteristics of a fusible element can be maintained.

Next, a further embodiment of the present invention, different from the previous embodiment in that the main body of a micro-chip fuse is constructed by lamination of two substrates, is explained.

The method of manufacturing such a micro-chip fuse will first be explained.

FIGS. 10A through 10H illustrate steps of the method of manufacturing a micro-chip fuse according to another embodiment of the present invention.

Figure 10A:
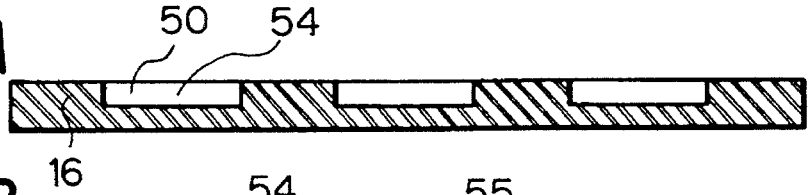

As shown in FIG. 10A, a plurality of recesses 50 are provided on a substrate 16. These recesses 50 constitute portions of spaces to be defined around fusible elements at the time of completion of manufacturing the fuses. For the purpose of causing fuse elements to be extended over those recesses 50, a photosensitive resist is used to temporarily fill these recesses 50. Photosensitive resist is poured into the recesses 50 provided on the substrate 16 and then cured to fill the recesses 50 with the so cured resist 54.

Figure 10B:
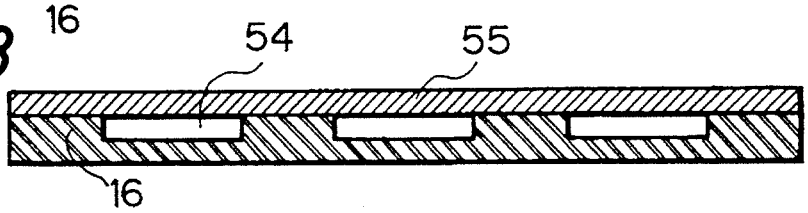

Subsequently as shown in FIG. 10B, metal is vapor-deposited to form a metallic film 55. Since the recesses 50 provided on the substrate 16 are filled with cured resist 54 and made smooth thereby, the metallic film 55 can be formed as a thin film having a uniform thickness.

Figure 10C:
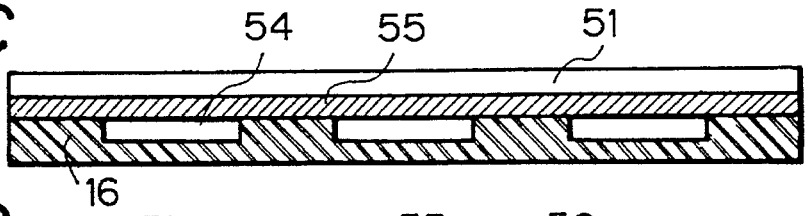

As illustrated in FIG. 10C, photosensitive resist 51 is applied on the vapor-deposited metallic film 55.

Figure 10D:
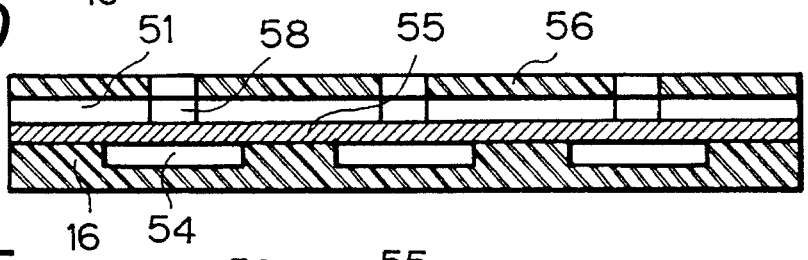

Subsequently, as shown in FIG. 10D, a photomask 56 having patterns corresponding to that of a fusible element is placed on the photosensitive resist 51, and then exposure is executed. Exposure causes the photosensitive resist 51 to be cured in the same pattern as that of a fusible element to provide a cured resist 58.

Figure 10E:
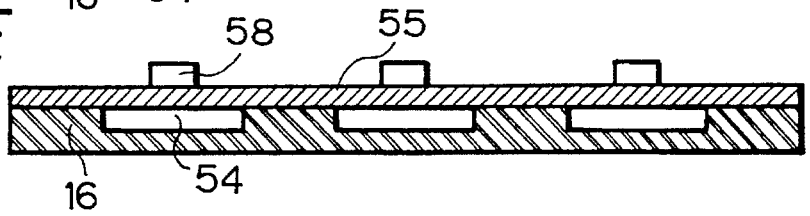

Then, as shown in FIG. 10E, the photomask 56 is taken away, and when the portion of the photosensitive resist 51 which has not been cured is washed with solvent and removed (a developing process), and the cured resist 58 having the same shape as that of the fusible element can be formed on the metallic film 55.

Figure 10F:
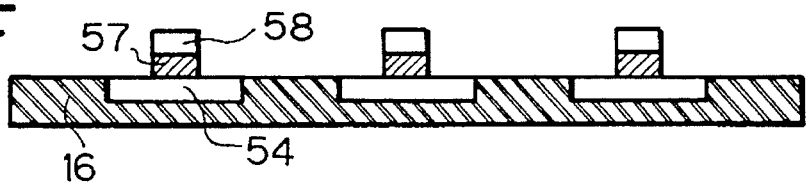

Subsequently as shown in FIG. 10F, when the metallic film 55 is etched, the portion of the metallic film 5 which is not covered with the cured resist 58 is removed, leaving the portion of the metallic film 55 which is covered with the cured photosensitive resist 58, which will become a fusible element 57.

Figure 10G:
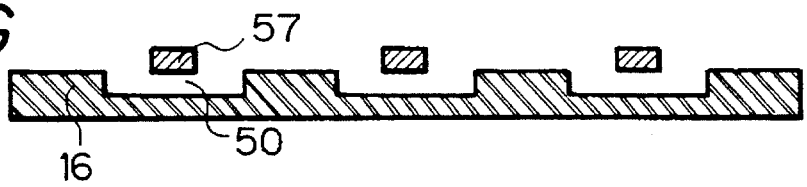

Subsequently as shown in FIG. 10G, the cured resists 58 and 54, which are respectively located on and under the fusible element 57, are removed. As a consequence, a fusible element 57 extended over the recess 50 is provided on the substrate 16.

Figure 10H:
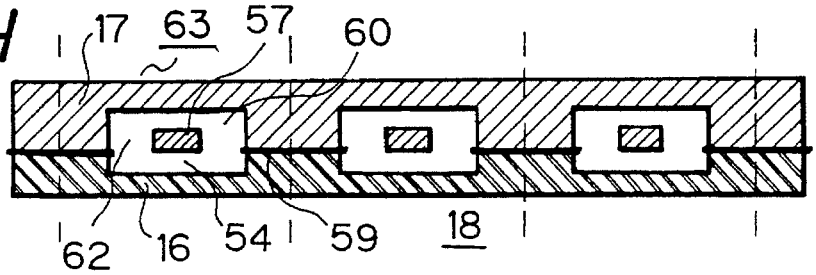

After that, as shown in FIG. 10H, a substrate 17 having recesses 60 corresponding to the recesses 54 provided on the substrate 16 is bonded to the substrate 16 by means of a bonding agent 59 in a manner where each recess 60 and each corresponding recess 54 are in alignment with each other to form a space 62 around the fusible element 57.

In this way, the space 62 is provided around the fusible element 57, and a construction is provided where the fused portion of the fusible element 57 does not come into contact with any part of the main body 63 of the fuse, comprised of the respective laminated substrates 16 and 17. In FIG. 10H, reference numeral 18 designates the fuse unit having a main body 63 comprised of two substrates 16 and 17 and, after being divided and respectively provided with electrodes, serves respectively as a fuse. The step of attaching electrodes to the fuse unit 18 is similar to that of the previous embodiment, and the external view of a micro-chip fuse provided with electrodes 13 and 13 is illustrated in FIG. 11.

Figure 11:
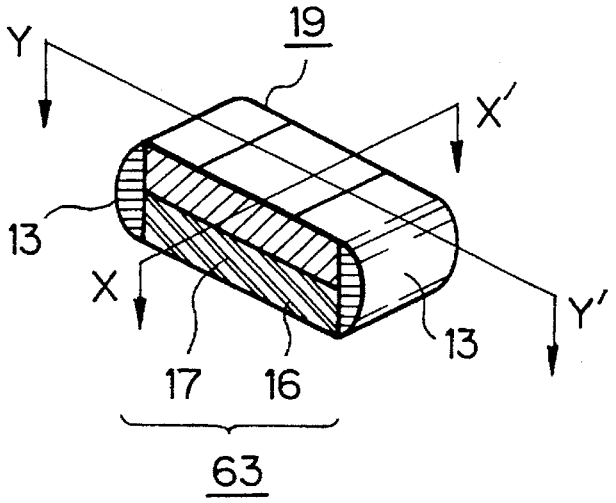
FIG. 11 is an external view of a micro-chip fuse made in accordance with the steps shown in FIGS. 10A through 10H.
Figure 12:
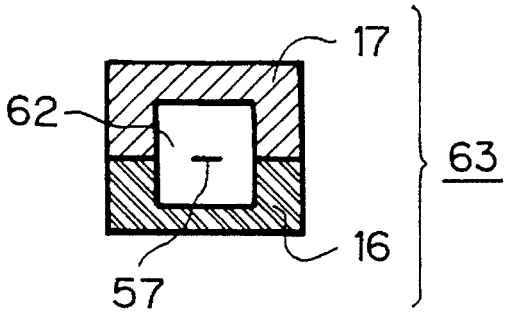
FIG. 12 is a sectional view taken along the line X—X' in FIG. 11.
Figure 13:
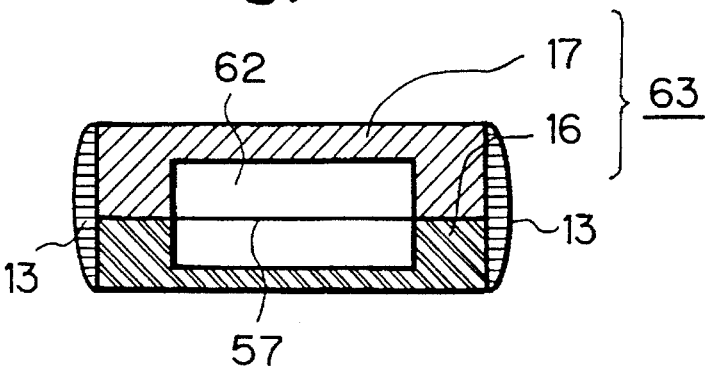
FIG. 13 is a sectional view taken along the line Y—Y' in FIG. 11.

FIG. 12 illustrates the sectional view of a micro-chip fuse 19 taken along the line X—X' in FIG. 11, while FIG. 13 illustrates the sectional view of a micro-chip fuse 19 taken along the line Y—Y' in FIG. 11.

Similar to the embodiment as described above, this micro-chip fuse 19 has a length of approximately 1.5–3 mm, a width of approximately 1.5 mm and a height of approximately 1.5 mm. The substrates 16, 17 constituting the main body 63 of a fuse, are respectively comprised of heat-resistant, electrically insulating materials having a thickness of less than 1 mm. Since the space 62 is defined around the fusible element 57, the heat which may be generated at the printed board on which surface a micro-chip fuse 19 is mounted is not conducted to the fusible element 57, and the heat which may be generated at the fusible element 57 does not escape externally along the main body 63 of the fuse.

The micro-chip fuse provided by this embodiment of the present invention does not cause, like the previous embodiment, the fused portion of the fusible element 57 between electrodes 13 to come into contact with any other portions of the fuse, and allows a fusible element 57 to be accommodated in the main body 63, comprised of heat-resistant, electrically insulating materials, thus providing the same effects as the previous embodiment.

The present invention has been described in detail with reference to certain preferred embodiments thereof, but it will be understood that variations and modifications can be effected within the spirit and scope of the invention.

What is claimed is:

1. A micro-chip fuse, comprising:

a main body comprising a plurality of laminated layers including at least two substrates made of heat-resistant, electrically insulating material, said main body defining a space therein;

a fusible element made of a metallic film formed by a deposition process, said fusible element comprising opposite end portions and a middle portion between said opposite end portions, wherein said opposite end portions are sandwiched between said at least two substrates and said middle portion extends within said space;

electrodes provided at opposite ends of said main body and electrically connected to said opposite end portions of said fusible element; and said at least two substrates comprises three substrates with one of said three substrates being sandwiched between the other two of said three substrates, the one of said three substrates having a through bore therein;

wherein one of the other two of said substrates has a recess therein; and wherein said space is formed by said recess of the one of the other two of said substrates, said through bore of the one of said three substrates and the other of the two of said three substrates.

2. The micro-chip fuse of claim 1, wherein the other of the two of said three substrates comprises a recess and said space is formed by said recesses of the other two of said three substrates and said through bore of the one of said three substrates.

3. The micro-chip fuse of claim 1, wherein said metallic film is fusible.

4. The micro-chip fuse of claim 3, wherein the other of the two of said three substrates comprises a recess and said space is formed by said recesses of the other two of said three substrates and said through bore of the one of said three substrates.

5. A micro-chip fuse, comprising:

a main body comprising a plurality of laminated layers including at least two substrates made of heat-resistant, electrically insulating material, said main body defining a space therein;

a fusible element that comprises a metallic film formed by the process of vapor depositing a metal on one of said at least two substrates and a resist and removing part of the metal and the resist through a photomasking and etching process, said fusible element comprising opposite end portions and a middle portion between said opposite end portions, wherein said opposite end portions are sandwiched between said at least two substrates and said middle portion extends within and is surrounded by said space; and electrodes provided at opposite ends of said main body and electrically connected to said opposite end portions of said fusible element.

6. The micro-chip fuse of claim 5, wherein said metallic film is fusible.

7. The micro-chip fuse of claim 6, wherein said at least two substrates comprise two substrates having respective recesses and said space is formed by said recesses.

8. The micro-chip fuse of claim 5, wherein said at least two substrates comprise two substrates having respective recesses and said space is formed by said recesses.

* * * * *